US007080424B2

(12) United States Patent
Kallenbach et al.

(10) Patent No.: US 7,080,424 B2
(45) Date of Patent: Jul. 25, 2006

(54) SWIMMING POOL CLEANER

(75) Inventors: Dieter H F Kallenbach, Linbro Park (ZA); Manfred Stahle, Linbro Park (ZA)

(73) Assignee: Corrupipe CC, Gauteng Province (ZA)

( * ) Notice: Subject to any disclaimer, the term of this patent is extended or adjusted under 35 U.S.C. 154(b) by 370 days.

(21) Appl. No.: 10/276,427

(22) PCT Filed: Jun. 25, 2001

(86) PCT No.: PCT/IB01/01122

§ 371 (c)(1),
(2), (4) Date: Nov. 15, 2002

(87) PCT Pub. No.: WO02/01022

PCT Pub. Date: Jan. 3, 2002

(65) Prior Publication Data

US 2003/0106174 A1 Jun. 12, 2003

(30) Foreign Application Priority Data

Jun. 30, 2000 (ZA) ..... 00/3305
Jan. 15, 2001 (ZA) ..... 01/0396
May 3, 2001 (ZA) ..... 01/3518

(51) Int. Cl.
*E04H 4/16* (2006.01)

(52) U.S. Cl. ..... 15/1.7; 137/624.14

(58) Field of Classification Search ..... 15/1.7; 210/169; 137/624.14, 907; 251/357, 61–61.2, 251/318, 319, 324
See application file for complete search history.

(56) References Cited

U.S. PATENT DOCUMENTS 2,853,270 A * 9/1958 Boteler ..... 251/331
4,671,490 A * 6/1987 Kolenc et al. ..... 251/335.2
5,384,928 A * 1/1995 Khoury ..... 15/1.7
5,655,246 A * 8/1997 Chang ..... 15/1.7
5,737,791 A * 4/1998 Durigon ..... 15/1.7

FOREIGN PATENT DOCUMENTS

EP 0745744A-1 12/1996
GB 2182551 A 5/1987

* cited by examiner

*Primary Examiner*—Gladys J. P. Corcoran
*Assistant Examiner*—Laura C Guidotti
(74) *Attorney, Agent, or Firm*—Baker Botts L.L.P.

(57) ABSTRACT

The invention concerns a swimming pool cleaner utilizing the induced flow to a filter plant pump to cause interrupted movement while cleaning the surface over which it operates. The cleaner incorporates a valve with a hollow domed perforated closure member operating in a body with the valve mounted on a stem carrying a rolling diaphragm or a piston subjected intermittently and automatically to the pressure induced by the filter plant pump.

17 Claims, 2 Drawing Sheets

SWIMMING POOL CLEANER

FIELD OF THE INVENTION

This invention relates to a swimming pool cleaner and more particularly to an automatically operated cleaner powered through the filter unit for the pool to be cleaned.

BACKGROUND OF THE INVENTION

Vacuum operated swimming pool cleaners are today well known and widely used, especially for cleaning domestic swimming pools. Most of these utilize an interruption of the water flow induced through the machine to impart a stepwise movement to the machine across the surface to be cleaned. While this movement takes place dirt on the surface is entrained in the water which flows through the machine to the pool filter.

U.S. Pat. No. 5,737,791 discloses an invention in which a reciprocating shuttle is made to cross a throat in an outlet passage from a pool cleaner in order to cause an interruption in the flow. The shuttle and the sleeve in which it operates are made to reduce friction. The front and back of the shuttle have the same area over which the reduced pressure in the pool cleaner is caused to act during use to move the shuttle. The dimensions of the passage conveying pressure to the back of the shuttle must also be calculated to cause this shuttle movement.

OBJECT OF THE INVENTION

It is an object of the present invention to provide an alternative operating mechanism to those presently available which is both effective and reliable.

SUMMARY OF THE INVENTION

In accordance with this invention there is provided a swimming pool cleaner comprising a surface engaging foot with an inlet passage therethrough opening into the forward end of a hollow body integral with the foot and having an outlet through a valve seal adjacent the inlet from the foot and inclined to the axis of the foot, a resilient valve mounted in the body subject in use to the pressure at the outlet and connected to a member movable with the valve and subject to pressure over a reduced area to that of the valve through a by-pass passage from the outlet into the body on the side of the member remote from the valve.

The invention further provides for the vale to be mounted on a stem extending away from the valve seat, the stem carrying a resilient diaphragm having its outer edge supported adjacent the wall of the body and a guide for the valve stem remote from the valve.

Preferably the diaphragm is of generally conical shape with forwardly curved portion extending between the base of the cone and the outer edge of the diaphragm and the valve stem has a conical section which supports a rolling action of the diaphragm during operation of the cleaner.

An alternative feature of this invention provides for the valve to be connected on the side remote from the outlet to the piston of a piston and cylinder assembly such that the pressure in the by-pass is applied to an annular area of the valve remote from the outlet being the difference between the valve and piston areas.

Further features of this invention provide for the axis of the body to be at right angles to the axis of the foot, for the outlet from the body to open into a rigid pipe projecting away from the body and foot at about 45° and for the pipe to open into an outer pipe opening into the by-pass passage and connectable to a flexible hose.

Still further features of this invention provide for the diaphragm to be biased to a position to close the valve and to be releasably supported in to the body, and for the biasing to be effected inherently by the material of the diaphragm or by a compression spring mounted to hold the valve in the closed position by acting on the valve stem.

The invention also provides for the valve closure member to be domed and hollow and made of resilient plastics material, for the edge of the valve closure member to be supported on a solid disc carried by the valve stem or piston.

Other features of this invention provide for the valve closure member to be perforated adjacent the edge of the supporting disc and to have an outwardly projecting co-axial rib arranged to contact the valve seat around the outlet opening from the body.

Also the valve closure member carries a peripheral flange of substantial width which may be in the form of a peripheral ring providing an outer longitudinally extending bearing surface to contact the inner wall of the body and the closure member may be moulded from material sold under the trade name "MOMPRENE®".

Yet further features of the invention provide the valve stem guide to form part of a closure assembly for the body remote from the valve and providing a screwthread to cooperate with a screwthreaded socket such that the screw threaded socket can act in use to secure a closure to the end of the body remote from the outlet or to withdraw the diaphragm and valve assembly from the body by release of the diaphragm support.

The invention also provides for the valve stem remote from the valve closure member to be in the form of an open cage slideable in a hollow cylinder at the rear of the body.

The body and foot assembly will also be provided with buoyancy and weighting components.

BRIEF DESCRIPTION OF THE DRAWINGS

These and other features of this invention will become apparent from the following description of preferred embodiments wherein reference is made to the accompanying drawings in which.

DETAILED DESCRIPTION OF THE INVENTION

Figure 1:
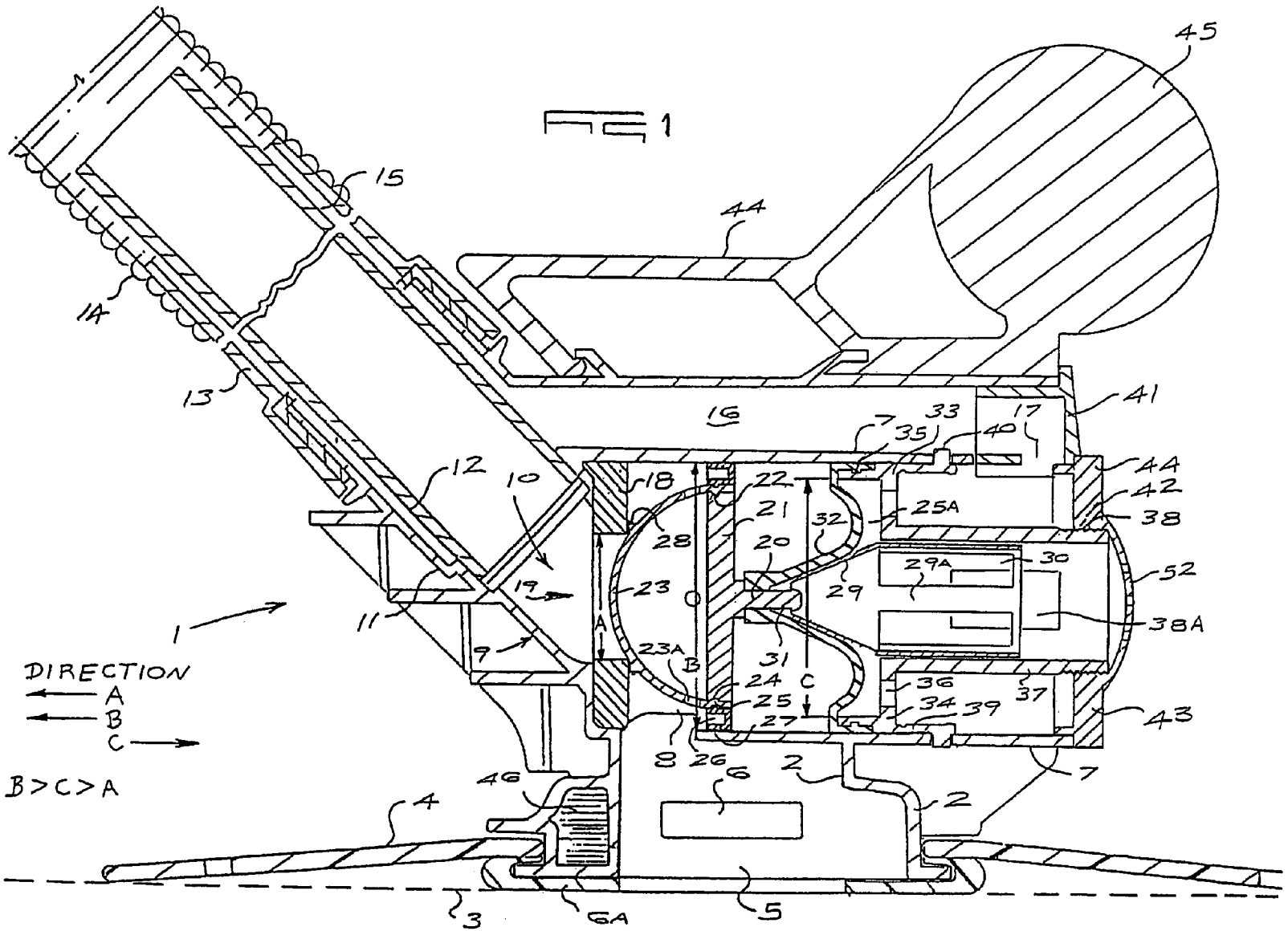
FIG. 1 is a longitudinal cross-section through the swimming pool cleaner.

As illustrated in FIG. 1, a pool cleaner (1) has a foot (2) to engage a submerged surface (3) of a swimming pool to be cleaned. The foot (2) carriers a flexible peripherally extending disc (4) commonly used with this type of pool cleaner.

The foot (2) has a large axial inlet passage (5) therethrough as well as a pair of symmetrically arranged openings (6) through the side of wall and carries a replaceable shoe (6*a*). This is also common for this type of pool cleaner. The openings are arranged to be at right angles to the direction of movement of the cleaner in use.

Integral with the foot (2) is a hollow body (7) of generally circular cylindrical cross-section with its axis normal to the axis of the passage (5). An inlet opening (8) into the body (7) is provided through the wall thereof from the passage (5). This opening (8) is located at the bottom of the body adjacent the end (9) providing an outlet (10) from the body.

The opening (8) extends around an arc of about 70 degrees around the lower part of the body (7).

The outlet (10) opens into a connection (11) inclined upwardly away from the foot (2). The connection (11) is shaped to receive a pair of concentric pipes (12) and (13), the inner one (12) of which is fixed and the outer one (13) is free to swivel with respect to the connection (11).

The outer pipe (13) is adapted for connection into the end of a flexible hose indicated at (14) which will connect the pool cleaner to the inlet of the pool filtration plant.

There is an annular space (15) between the pipes (12) and (13) which opens into a by-pass passage (16) built into the body (7).

This passage (16) connects to a radial inlet (17) into the body.

A valve seat (18) is provided around the opening (10) into the body (7).

Co-operating with the valve seat (18) is a valve (19) on the end of a valve stem (20). The valve stem carries a disc (21) with a peripheral grove (22) adapted to receive and return the edge of the valve closure member (23). This closure member (23) is moulded from resilient wear resistant plastics material which can conveniently be a material sold commercially under the trade name "MOMPRENE®." Other suitable compositions such as rubber and polyurethane can also be used.

The closure member (23) is a hollow dome shaped member and is perforated adjacent the base of the dome preferably by a series of holes (23A) spaced apart and extending around the base.

The rim of the closure member has a groove (24) in the outer surface which is engaged by a rib (25) extending from an annular peripheral ring (26). This is shown to have a wall of U-shaped cross-section and to provide a longitudinally extending bearing surface (27) which will slide on the inner wall of the body (7)

The closure member (23) also carries an outwardly projecting co-axial annular rib (28). This rib (28) in use seats against the valve seat (18) around the outlet opening (10) from the body of the cleaner.

The valve stem (20) has cone-shaped member (29) formed thereon on which a diaphragm (32) (referred to below) can roll as its flexes with movement of the valve assembly.

The effect of rolling is thus constrained around the area indicated at (25A) and no puckering of the diaphragm material takes place. The limited axial movement of the valve assembly reduces the possibility of any failure of the diaphragm in the area indicated at (25A).

The end of the valve stem (20) remote from the closure (23) is expanded to form a cylindrical longitudinally extending cage (29A) with large openings (30) through the wall thereof.

The free end of the cage (29A) is also open.

The cage (29A) is a sliding fit in the co-axial hollow cylinder (37) at the rear of the body (7).

Along the length of the valve stem (20) an annular recess (31) is provided in which is mounted the inner edge of an annular resilient rolling diaphragm (32). The outer edge of the diaphragm is secured to a support (33) such that the edge of the diaphragm is located in sealing engagement with the inner wall of the body (7).

The support (33) is in the form of an annular disc (34) which has an operatively forwardly extending flange (35) to locate the edge of the diaphragm (32) against the inner surface of the wall of the body (7). The annular disc (34) has a series of apertures (35) which permit water flow, and consequently pressure variation to the inside of diagram (32).

Rearwardly of disc (34) extends a co-axial hollow cylinder (37) screwthreaded on its outer end at (38). The cylinder is open at its free end.

The expanded end of valve stem (20) slides through a central aperture in the disc (34) forming the operatively forward end of the cylinder (37). The cylinder (37) has oppositely disposed openings (38A) into the body (7).

The disc (34) and cylinder (37) are mounted into the rear end of the body (7) by means of a pair of oppositely disposed resilient fingers (39) extending rearwardly from the disc (34) and carrying pinties (40) which engage in holes provided therefore through the wall of the body (7).

A closure cap indicated at (41) in the by-pass passage (16) is provided to co-operate with a larger screwthreaded socket member (42) providing a grip (43) and also an outwardly extending radial flange. The combination of the closure cap (41) and socket member (42) enable the rear end of body (7) and by-pass passage (16) to be sealed off as the socket member (42) is screwed onto the end of the cylinder (37). The latter is trapped in the body on the pinties (40) referred to above.

It will be appreciated that the above construction makes the installation and removal of the complete valve and diaphragm assembly a simple and convenient operation. With minor modifications to the embodiment illustrated the socket member (42) can be made to have an extension which will trap the fingers (39) when the socket member (42) is fully engaged on the cylinder (37). This will positively secure the valve mechanism in the body (7).

A carrying handle (44) is provided above the by pass passage (16).

Balance for the cleaner is provided by a float (45) above the rear end of the body (7) and a weight (46) located around the operatively front end of the foot (2). The float (45) is made integral with the handle and both are located and secured in position by the socket member (42).

Figure 2:
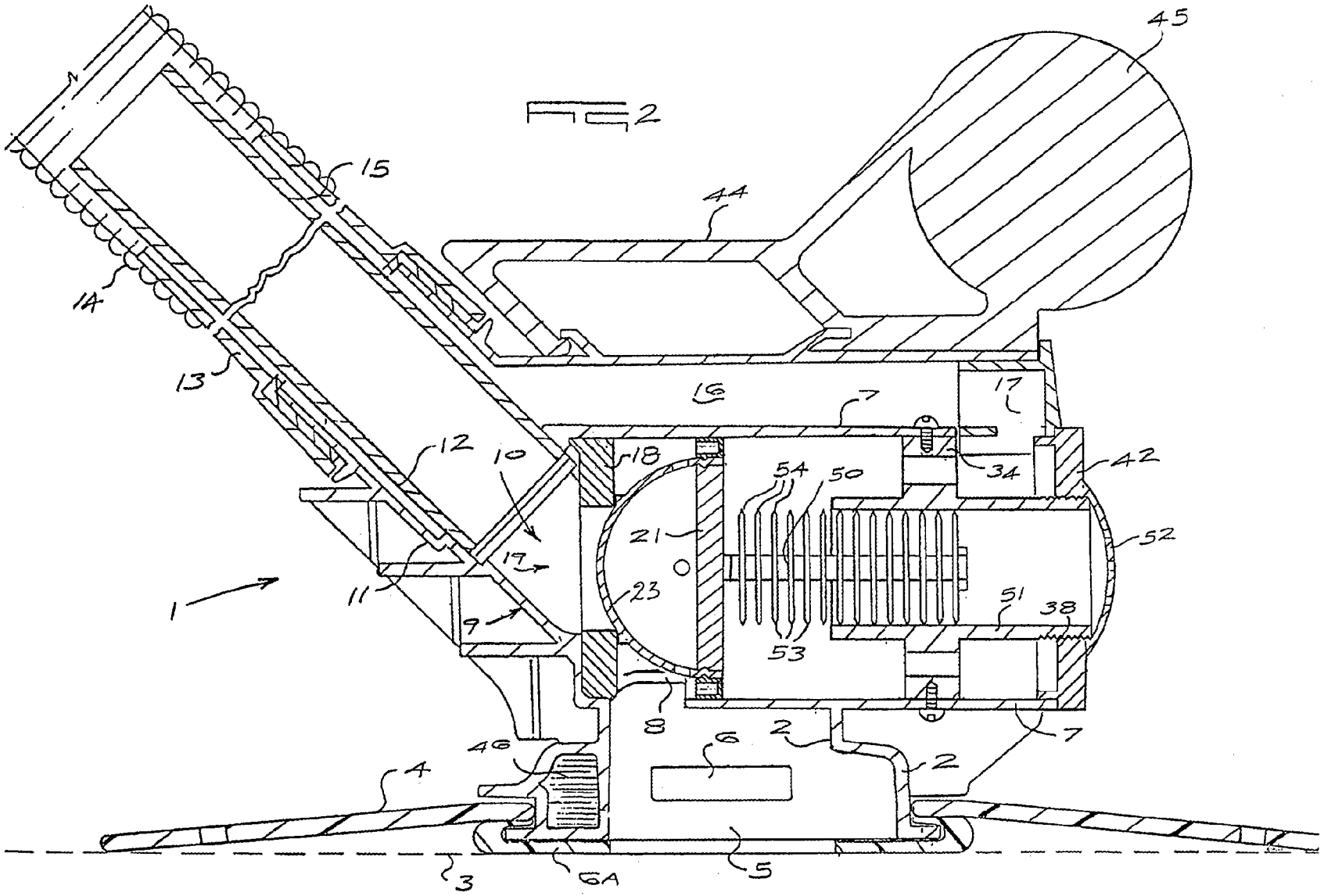
FIG. 2 is a similar view of an alternative construction.

Referring to FIG. 2 there is illustrated an alternatively construction whereby reduced pressure can be exerted on the closure member (23) remote from the outlet (18).

In this arrangement the diaphragm has been replaced by a piston (50) and cylinder (51) assembly. The annular disc (34) is provided around the cylinder and is located in the body (7) as in the embodiment in FIG. 1. The cylinder (51) extends on each side of the disc (34) and is screwthreaded at (38) to receive the socket member (42).

The closed end (52) of the socket member (42) is perforated to provide a sieve to permit the flow of water in and out of cylinder (51) but restrict entry of debris.

The piston (50) may be a hollow cylinder closed at its one end by the disc (21) but it is preferred that it be formed to have a series of radial fins (53) with flexible tips (54).

In use flow is induced through the foot (2) and through inlet opening (8) into the outlet pipe (12) by the pump of a swimming pool filtration plant.

This flow causes a reduction in pressure at the outlet opening (10) which results in the valve (19) being drawn into the position shown in the drawing. The effect is obtained by the reduced pressure acting over the full area of the valve (19) until the outlet opening (10) is closed.

The suction induced reduction in pressure also acts through the by-pass passage (16) and opening (17) in the body (7) on the side of the diaphragm (32) or the disc (21) remote from outlet opening (10). The area over which this reduced pressure acts is the annular area of the diaphragm around the valve stem (20) or around the area of the piston (50).

With the outlet opening (10) closed, the reduced pressure on the annular diaphragm area or around the piston area pulls the valve (19) into its open position and water can flow through the foot (2) and body (7) into the outlet pipe (12) and thence to the pool filter. Once the valve opens the cycle will be repeated.

In both the embodiments of the invention described above the interruption in flow through the cleaner described above is used in the known manner for pool cleaners of this kind to cause a stepwise movement of the cleaner over a submerged surface on which the cleaner is placed. The water drawn through the cleaner entrains dirt and debris which is removed by the filter before the water is returned to the swimming pool.

The oscillation of the water in the outer pipe, the by-pass passage and body on the side of the valve remote from the inlet supplies a propulsive force each time the outlet opening is closed.

It has been found that the pool cleaner is efficient and capable of cleaning substantially sized objects from the surface being cleaned. This is facilitated by the construction of the closure member (23) where water may flow in and out of the resilient dome shape of the member adding to the flexibility thereof. This consequently enables the cleaner to operate satisfactorily even when the member (23) closes against debris passing from the foot through the outlet.

The descriptions have been given as applied to domestic swimming pool cleaners but it will be understood the machine could be used for cleaning other submerged surfaces such as reservoirs for example.

The invention claimed is:

1. A swimming pool cleaner comprising:

a surface engaging foot having an inlet passage therethrough opening into a forward end of a hollow body integral with the foot and having an outlet through a valve seat adjacent the inlet from the foot and inclined to an axis of the foot;

a valve including a resilient valve closure member in cooperating relationship with the valve seat and mounted on a disc carrying a valve stem, the valve defining a full area that is the subject in use to a pressure at the outlet, and a movable member supported by the valve stem and defining an area less than the full area of the valve that is subject in use to a pressure through a by-pass passage from the outlet to a side of the movable member remote from the valve.

2. A swimming pool cleaner as claimed in claim 1, wherein the valve stem carries within an inner wall of the body a resilient diaphragm having an outer edge supported adjacent the wall of the body and a guide for the valve stem remote from the valve.

3. A swimming pool cleaner as claimed in claim 2, wherein the diaphragm is of generally conical shape with a forwardly curved portion extending between an inner edge mounted to the valve stem and the outer edge of the diaphragm.

4. A swimming pool cleaner as claimed in claim 3, wherein the valve stem has a conical section which supports a rolling action of the diaphragm during operation of the cleaner.

5. A swimming pool cleaner as claimed in claim 2, wherein the diaphragm is biased to a position to close the valve.

6. A swimming pool cleaner as claimed in claim 5, wherein the diaphragm is made of resilient material.

7. A swimming pool cleaner as claimed in claim 2, wherein the valve stem guide forms part of a closure assembly for the body remote from the valve.

8. A swimming pool cleaner as claimed in claim 7, wherein the valve stem guide provides a screwthread to co-operate with a screwthreaded socket such that the socket can be used to secure closure of the end of the body remote from the outlet.

9. A swimming pool cleaner as claimed in claim 8, wherein the axis of the body is at right angles to the axis of the foot and the outlet from the body opens into a rigid pipe projecting away form the body and the foot at an angle of about 45° and the pipe opens into an outer pipe opening into the by-pass passage, the outer pipe being connectable to a flexible hose.

10. A swimming pool cleaner as claimed in claim 1, wherein the valve has a closure member which is hollow and domed and made of resilient plastics material.

11. A swimming pool cleaner as claimed in claim 10, wherein the edge of the valve closure member is supported on a solid disc and carries a peripheral guide slideable in the body.

12. A swimming pool cleaner as claimed in claim 10, wherein apertures extend into the hollow closure member.

13. A swimming pool cleaner as claimed in claim 1, wherein the valve has an outwardly projecting rib arranged to contact the valve seat around the outlet opening from the body.

14. A swimming pool cleaner as claimed in claim 1, wherein the valve carries a peripheral flange of substantial width.

15. A swimming pool cleaner as claimed in claim 14, wherein the flange forms a peripheral ring providing a longitudinally extending bearing surface to contact the inner wall of the body.

16. A swimming pool cleaner as claimed in claim 1, wherein the valve stem carries a piston movable in a cylinder integral with the body such that in use the pressure in the by-pass is applied to an annular area around the piston.

17. A swimming pool cleaner as claimed in claim 1, wherein the axis of the body is at right angles to the axis of the foot and the outlet from the body opens into a rigid pipe projecting away from the body and the foot at an angle of about 45° and the pipe opens into an outer pipe opening into the by-pass passage, the outer pipe being connectable to a flexible hose.

* * * * *